US006148621A

United States Patent [19]

Byczynski et al.

[11] Patent Number: 6,148,621

[45] Date of Patent: Nov. 21, 2000

[54] DOMESTIC CLEAR ICE MAKER

[75] Inventors: Dean Byczynski, Hartland; Karl R. Krumbiegel, Cedarburg; Cary J. Pierskalla, Manitowoc; William A. Reed, Cedarburg; Charles E. Schlosser, Manitowoc; Jeffrey Ziminski, Milwaukee, all of Wis.

[73] Assignees: U-Line Corporation, Milwaukee, Wis.; Manitowoc Foodservice Group, Inc., Sparks, Nev.

[21] Appl. No.: 09/547,840

[22] Filed: Apr. 12, 2000

Related U.S. Application Data

[62] Division of application No. 09/263,045, Mar. 5, 1999, Pat. No. 6,058,731, which is a continuation of application No. 08/828,761, Apr. 1, 1997.

[60] Provisional application No. 60/082,145, Apr. 17, 1998.

[51] Int. Cl.[7] ..... F25C 1/12

[52] U.S. Cl. ..... 62/73; 62/135; 62/233

[58] Field of Search ..... 62/73, 135, 155, 62/156, 233

[56] References Cited

U.S. PATENT DOCUMENTS

| | | | |
|---|---|---|---|
| 2,645,910 | 7/1953 | Leeson | 62/347 |
| 2,836,038 | 5/1958 | Morgan | 62/344 |
| 3,021,686 | 2/1962 | Alt | 62/344 |
| 3,144,755 | 8/1964 | Kattis | 62/344 |
| 3,171,266 | 3/1965 | Weiss | 62/347 |
| 3,423,952 | 1/1969 | Pugh | 62/344 |
| 3,430,452 | 3/1969 | Dedricks et al. | 62/138 |
| 4,458,503 | 7/1984 | Nelson | 62/347 |
| 4,722,199 | 2/1988 | Hibino | 62/344 |
| 5,065,584 | 11/1991 | Byczynski et al. | 62/81 |
| 5,129,237 | 7/1992 | Day et al. | 62/73 |
| 5,237,837 | 8/1993 | Naruse et al. | 62/434 |
| 5,586,439 | 12/1996 | Schlosser et al. | 62/78 |

FOREIGN PATENT DOCUMENTS

| | | |
|---|---|---|
| 0 505 315 A1 | 3/1992 | European Pat. Off. . |
| 07234049 | 5/1995 | Japan . |

OTHER PUBLICATIONS

European Search Report dated Oct. 25, 1999 in EPO Appln. No. 98302147.8–2301.

*Primary Examiner*—William E. Tapolcai
*Attorney, Agent, or Firm*—Quarles & Brady LLP

[57] ABSTRACT

An ice maker in which a non-metallic shroud surrounds the metal evaporator plate and has a continuous bulbous edge that engulfs the edges of the plate. The shroud further includes a roof disposed above the plate and slopes toward the front of the plate. The water distributor of the ice maker is mounted on the roof of the shroud.

3 Claims, 8 Drawing Sheets

FIG. 3
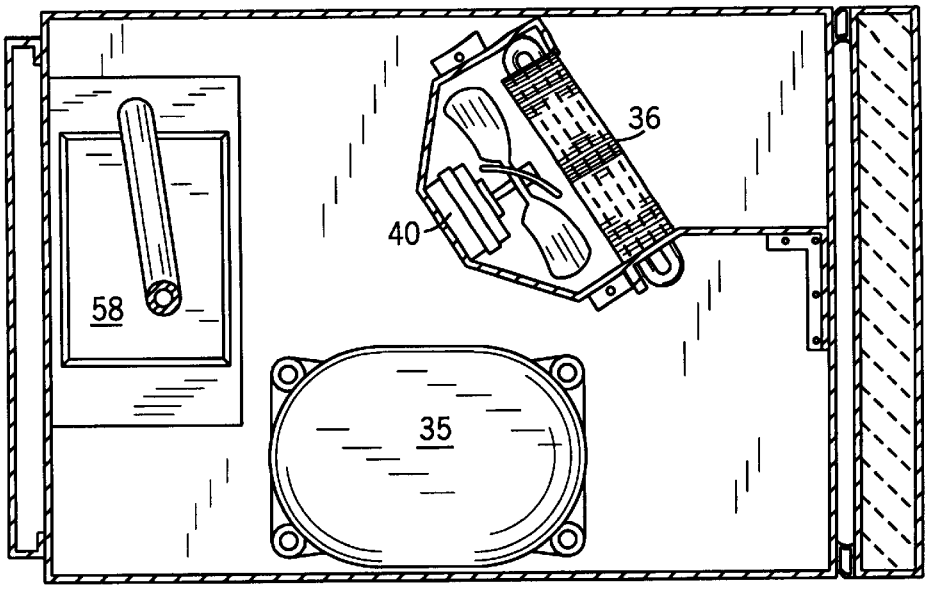
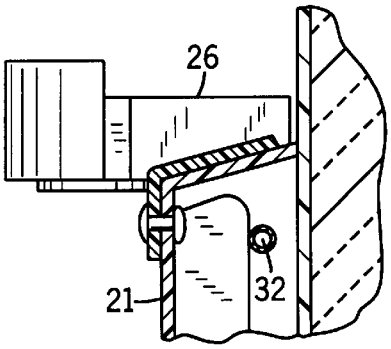
FIG. 7
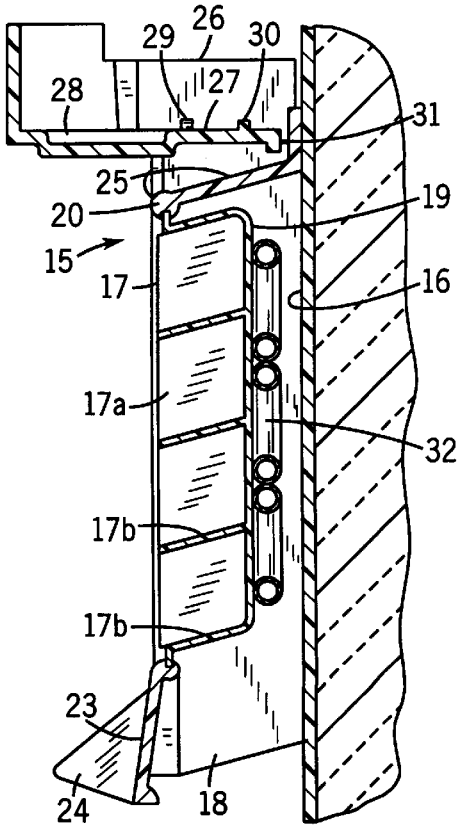
FIG. 6

DOMESTIC CLEAR ICE MAKER

This is a divisional of Application No. 09/263,045, filed Mar. 5, 1999, now U.S. Pat. No. 6,058,731, which is continuation of U.S. patent application Ser. No. 08/828,761 filed Apr. 1, 1997, now U.S. Pat. No. 5,878,583, the disclosure of which is hereby incorporated by reference, and this claims the benefit of U.S. Provisional Application No. 60/082,145 filed Apr. 17, 1998.

BACKGROUND OF THE INVENTION

This invention relates to the manufacture of ice, and particularly to a small residential or domestic maker of clear ice cubes.

Typical domestic or residential ice makers form ice cubes by depositing water into a mold attached to an evaporator and allowing the water to freeze in a sedentary state. Such an approach results in clouded ice cubes as a result of the entrapped air and impurities.

It is known that forming ice by flowing water over a freezing surface will eliminate the clouding associated with sedentary freezing. Such a flowing water process has typically been used in commercial ice cube makers. One example of the flowing water approach is shown in U.S. Pat. No. 5,586,439 issued Dec. 24, 1996 to Schlosser et. al. In that patent, water is flowed over a vertically disposed evaporator plate whose surface defines pockets. The water flows over the surfaces of the pockets and an ice cube is formed in each pocket. The ice cubes are harvested by passing hot vaporous refrigerant through the evaporator in place of the cold refrigerant.

The present invention incorporates such a flowing water system in a small unit for residential or domestic uses.

SUMMARY OF THE INVENTION

In accordance with the invention, a clear ice maker has a cabinet with an upper ice making portion and a lower bin portion. An evaporator assembly of a metal plate connected to an evaporator is mounted against one wall of the upper portion of the cabinet. The metal plate has vertical and horizontal partitions defining pockets open to the interior of the cabinet. A water distributor is disposed above the shroud to distribute water over all of the plate pockets. A trough is mounted beneath the plate and leads to a sump which receives a water pump that recirculates water from the sump to the distributor.

Further in accordance with the invention, an overflow pipe is disposed in the sump with an open top to control the level of water in the sump. The sump may be fed periodically from a water source through a controlled water fill valve. Preferably, the sump is overfilled after each freeze cycle to wash away accumulated impurities.

The metal plate has lateral edges projecting forward from a rear wall and a shroud surrounds the plate and has a continuous bulbous edge that engulfs the edges of the plate. The shroud has a roof above the plate and sloping toward the open pockets. The distributor has a floor with upright barriers between the front of the floor and a rear edge. The barriers distribute water that is deposited at the front of the floor to fall uniformly over the rear edge and onto the roof of the shroud.

Preferably, the shroud has a bib portion extending downwardly from plate with deflector fins that deflect ice leaving the pockets over the trough and into the bin portion.

Also according to the invention, a refrigeration system for the clear ice maker includes an accumulator at the outlet of the evaporator and leading to a compressor. The refrigerator system is preferably provided with a controllable hot gas bypass between the compressor outlet and the evaporator inlet to provide hot refrigerant gas to the evaporator to loosen ice cubes formed in the pockets.

The invention further includes a method of controlling the freezing and harvesting of ice cubes in which the temperature of the liquid refrigerant leaving the condenser of the refrigeration system is sensed at a fixed time after initiation of a freezing cycle, and the length of the freezing cycle is directly related to the sensed temperature. The temperature of the liquid refrigerant is again sensed at a fixed time before the end of the freezing cycle, and the length of the harvesting cycle is inversely proportional to the second sensed temperature.

It is an object of the invention to provide a clear ice maker having a vertical partitional evaporator plate which is molded into a shroud that receives a water distributor of improved design.

It is another object of the invention to provide a clear ice maker in which a water sump contains a circulating pump and a trough beneath the evaporator plate to continuously recycle the water over the evaporator plate.

It is another object of the invention to provide an improved method for the operation of the water circulation and refrigerant systems for the production and harvesting of clear ice.

It is a further object of the invention to provide a refrigerant system for a clear ice evaporator plate which includes an accumulator following the evaporator.

It is yet another object of the invention to provide an overflow pipe in the sump.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 3 is a top plan view taken in the plane of the line 3—3 of FIG. 1;

FIG. 6 is a view in vertical section through the evaporator plate assembly and taken in the plane of the line 6—6 of FIG. 4;

FIG. 7 is a view in vertical section taken in the plane of the line 7—7 in FIG. 4;

DETAILED DESCRIPTION OF THE PREFERRED EMBODIMENT

Figure 1:
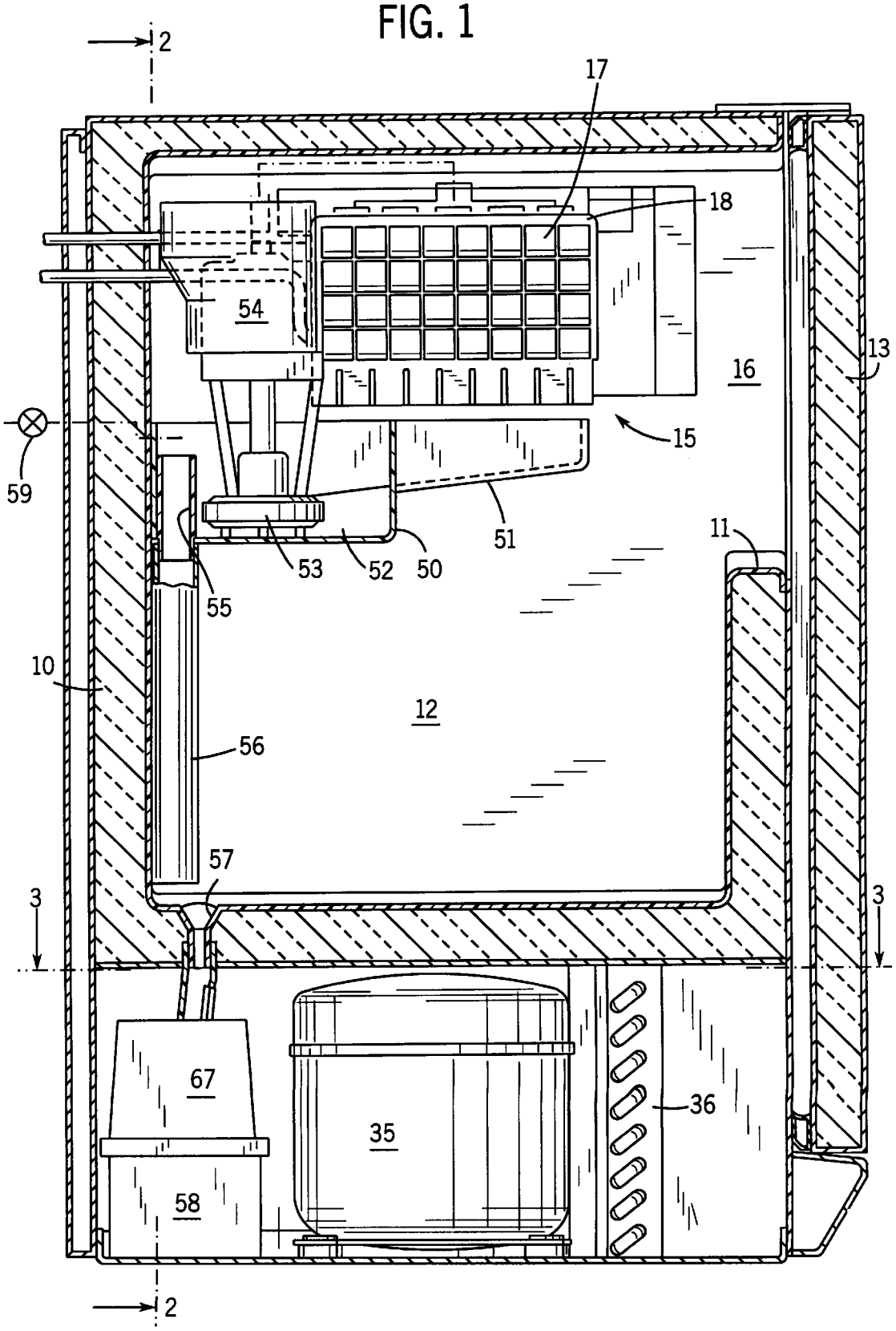
FIG. 1 is a view in vertical section and partially in vertical elevation of an ice maker according to the present invention.
Figure 2:
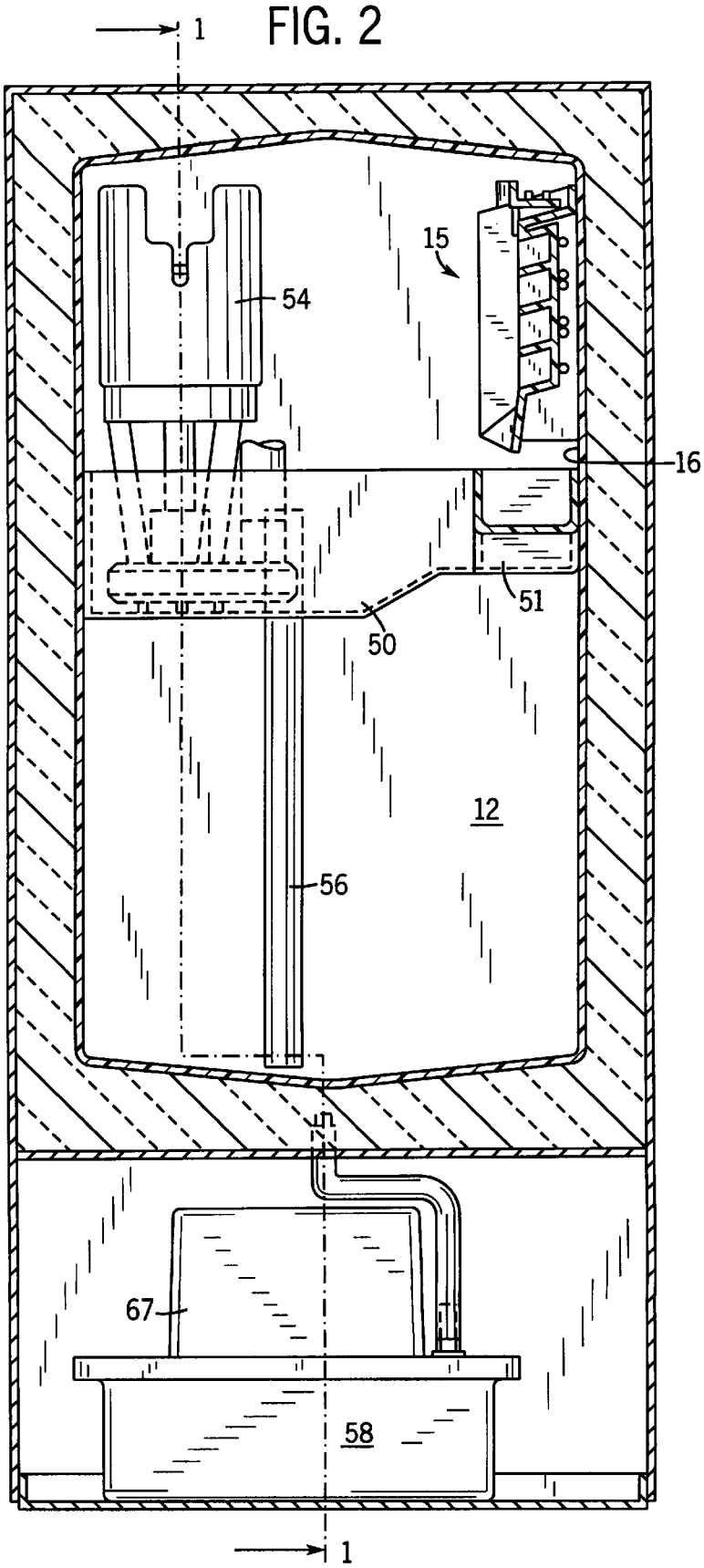
FIG. 2 is a view in vertical section taken in the plane of the line 2—2 of FIG. 1.

Referring to FIGS. 1 and 2, the clear ice maker includes a cabinet 10 with an upper forward opening 11 and a bin area 12 beneath the bottom edge of the opening 11. The opening 11 is closed by a door 13 that is hinged to the cabinet 10. Both the cabinet and door are formed of inner molded plastic members and outer formed metal members with the space filled with an insulating layer of foam material, all of which is well known in the art.

An evaporator plate assembly indicated generally by the numeral 15 is attached to one side wall 16 of the cabinet 10 in an upper freezing portion of the cabinet. The evaporator plate assembly 15 includes a metal evaporator plate 17 mounted in a shroud 18. The evaporator plate 17 has a series of vertical and horizontal dividers 17*a* and 17*b*, respectively, which extend from a rear wall 19 and between lateral edges to divide the evaporator plate into a series of pockets. As best shown in FIG. 6, the horizontal dividers 17*b* slope towards the bottom front of the evaporator plate 17.

Figure 4:
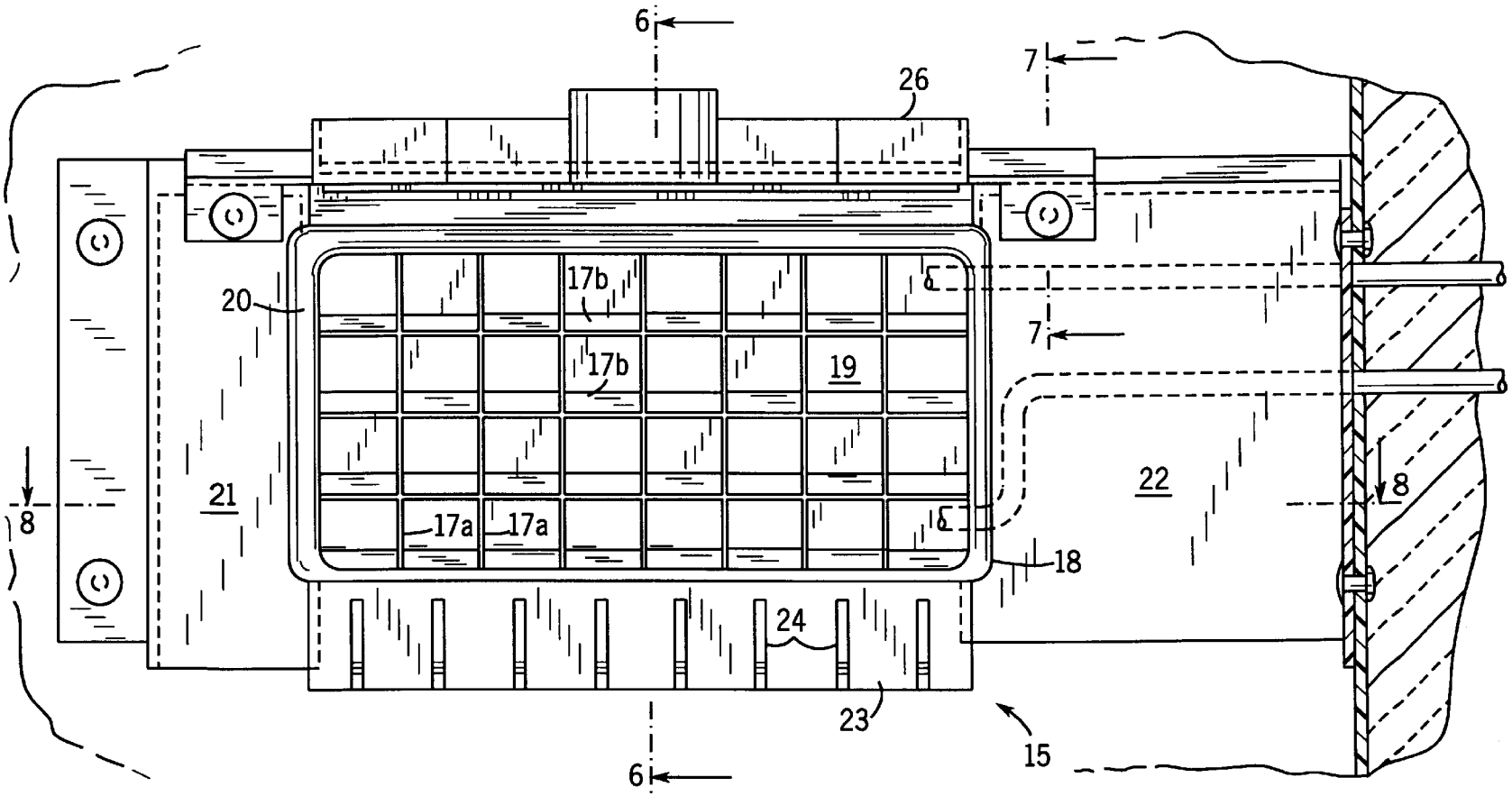
FIG. 4 is an enlarged front view of the evaporator plate assembly.
Figure 8:
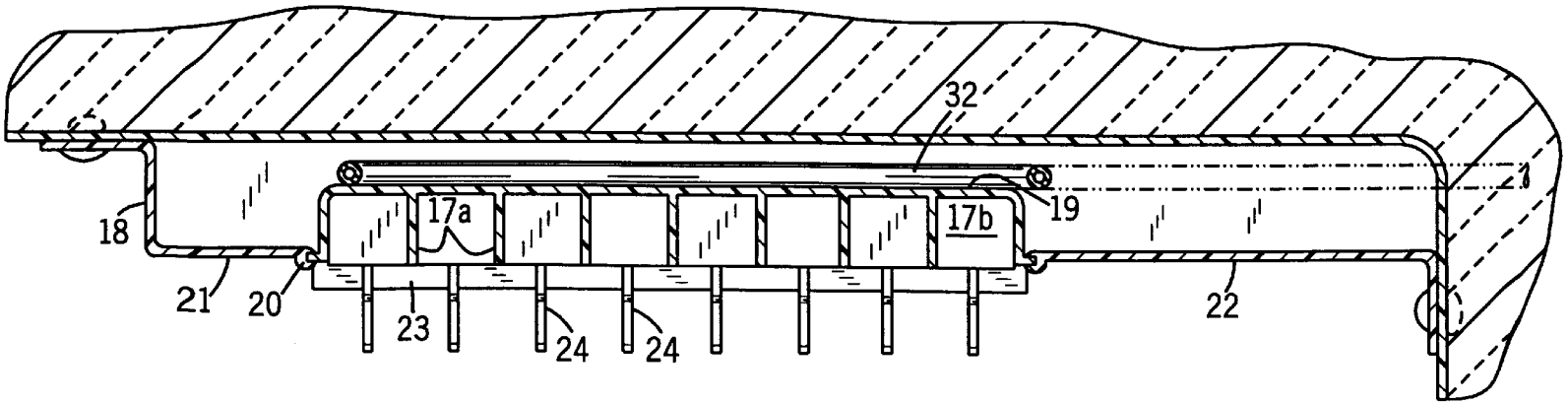
FIG. 8 is a view in horizontal section taken in the plane of the line 8—8 in FIG. 4.

The shroud 18 is formed of a plastic material such as a polypropylene or ABS and is molded about the evaporator plate 17. As best shown in FIGS. 6 and 8, the shroud 18 has a continuous bulbous edge 20 which engulfs the edges of the evaporator plate 17. As shown in FIG. 4, the shroud 18 has laterally extending portions 21 and 22 projecting from each end of the evaporator plate 17. A bib portion 23 of the shroud 18 is disposed beneath the bottom edge of the evaporator plate 17 and contains integral projecting deflector fins 24. Each deflector fin 24 is aligned with the center of a column of pockets in the evaporator plate 17.

Figure 5:
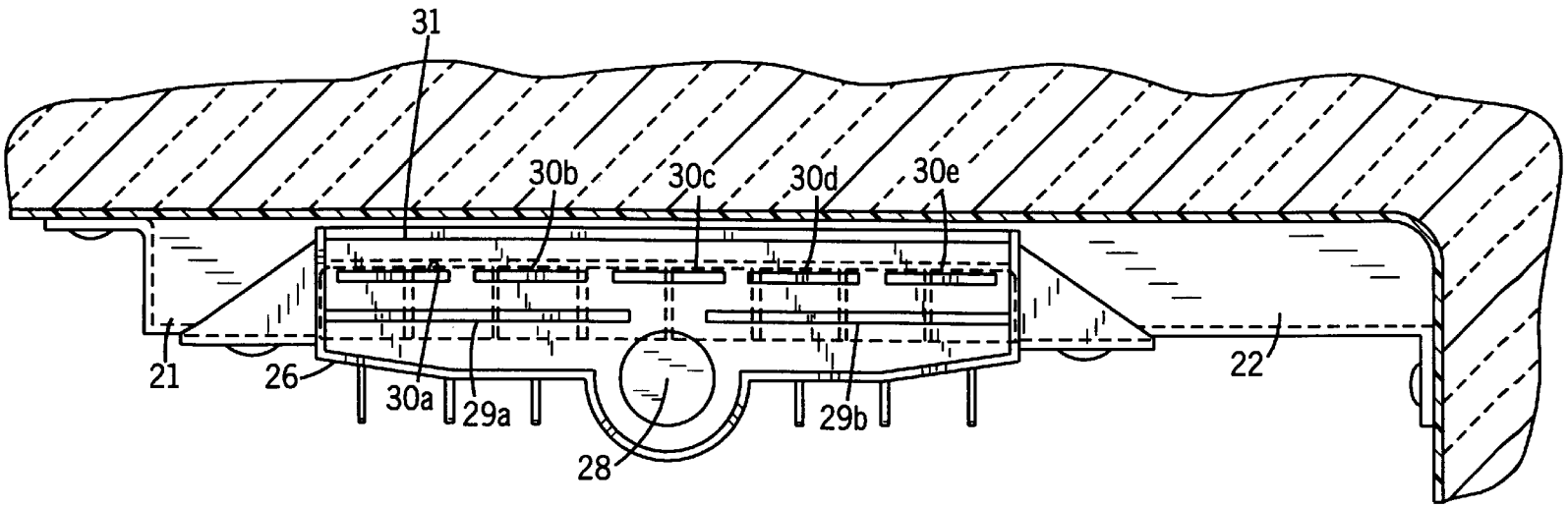
FIG. 5 is a top plan view of the evaporator plate assembly of FIG. 4.

The shroud 18 also includes an inclined roof 25 disposed above the evaporator plate 17. A water distributor 26 is attached to the shroud wings 21 and 22 above the roof 25. As shown in FIGS. 5 and 6, the distributor 26 has a floor 27 with a central well 28 at one edge. Spaced upright barriers 29*a* and 29*b* extend from the floor 27 beyond the wall 28. A second series of spaced barriers 30*a*, 30*b*, et. sec. extend between the barriers 29*a* and 29*b* and a rear edge 31 of the floor 27. Water deposited in the wall 28 will be directed by the barriers 29 and 30 to flow uniformly over the rear edge 31 and on to the inclined roof 25. The water will thereafter flow over the roof 25 of the shroud 18, and into and over the surfaces of the pockets in evaporator plate 17.

The shroud 18 and evaporator plate 17 with the distributor 26 attached thereto, are mounted on the inner wall of the cabinet with rivets as shown in FIGS. 4 and 8. An evaporator 32 is attached to the rear wall 19 of the evaporator plate 17. The evaporator 32 is a part of a refrigeration system shown schematically in FIG. 9. The evaporator 32 has an outlet line 33 which passes through an accumulator 34 to a compressor 35. The accumulator 34 functions in part as a reservoir for liquid refrigerant so that only gas is fed to the compressor 35. The output of the compressor 35 is connected to the inlet of a condenser 36 having an outlet line 37 connected to a dryer 38. A capillary tube 39 leads from the dryer 38 to an inlet of the evaporator 32.

As is known, the compressor 35 draws refrigerant from the evaporator 32 and accumulator 34 and discharges the refrigerant under increased pressure and temperature to the condenser 36. The hot refrigerant gas entering the condenser 36 is cooled by air circulated by a fan 40. As the temperature of the refrigerant drops under substantially constant pressure, the refrigerant in the condenser 36 liquefies. The capillary tube 39 maintains the high pressure in the condenser 36 and at the compressor outlet while providing substantially reduced pressure in the evaporator 32. The substantially reduced pressure in the evaporator 32 results in a large temperature drop and subsequent absorption of heat by the evaporator 32.

Figure 9:
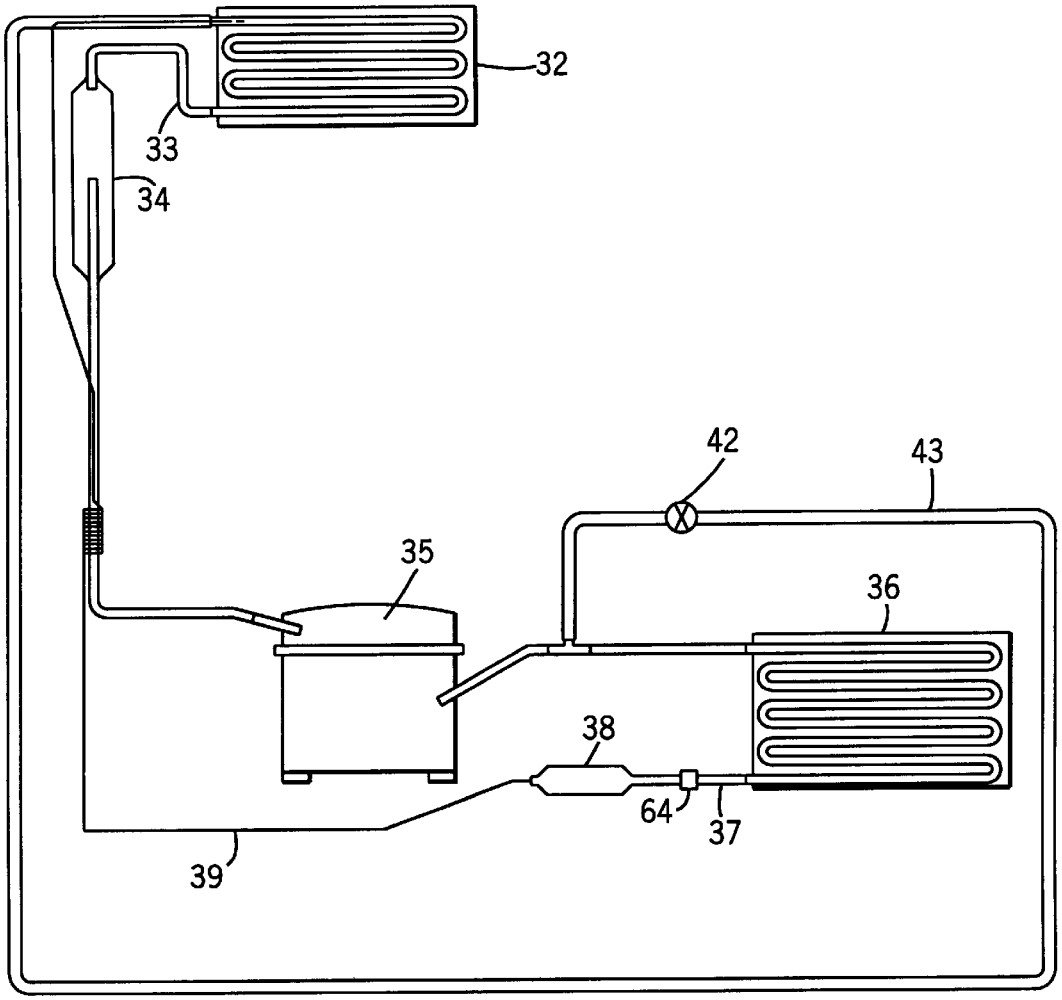
FIG. 9 is a schematic view of the refrigerant system for the ice maker.

The refrigeration system of FIG. 9 includes a hot gas bypass valve 42 disposed in a line 43 between the outlet of the compressor 35 and the inlet of the evaporator 32. When the hot gas bypass valve 42 is opened, hot refrigerant will enter the evaporator 32, thereby heating the evaporator plate 17. Such a hot gas bypass system is described in U.S. Pat. No. 5,065,584 issued Nov. 19, 1991, for "Hot Gas Bypass Defrosting System".

The compressor 35, condenser 36, and fan 40 are located at the bottom of the cabinet 10 beneath the insulated portion, as shown in FIGS. 1 and 3.

A water sump 50 has a trough portion 51 extending beneath the evaporator plate assembly 15. The trough 51 extends along the one side wall of the cabinet, along a rear wall, and to an opposite side wall of the cabinet. The bottom of the trough portion slopes downwardly to the level of a well 52 in which the inlet 53 of a water pump 54 is mounted. The outlet of the water pump 54 is connected to the well 28 in the distributor 26. An overflow pipe 55 extends into the sump 50 and leads to a stand pipe 56. The overflow pipe is removable. The stand pipe 56 opens to a drain 57 in the bottom of the bin area 12 in the cabinet 10. The drain 57 can be connected to a drain in the home plumbing. Alternatively, the drain 57 may lead to an overflow collector 58 in the space beneath the insulated portion of the cabinet 10. Fresh water from an external source may be provided periodically to the sump 50 through a water fill valve 59.

In general operation, water from the sump 50 is pumped by the pump 54 to the distributor 26 which delivers a cascade of water over the surfaces of the evaporator plate 17. When the evaporator 32 is connected to receive liquefied refrigerant from the condenser 36, the water cascading over the surface of the evaporator plate 17 will freeze forming cubes of ice in the pockets The pure water freezes first and impurities in the water will be left in suspension in the flowing water. Once the ice cubes are formed, the hot gas bypass valve 42 is opened and heated refrigerant is delivered to the evaporator 32, thereby warming the surface of the evaporator plate 17 until the ice cubes dislodge from the evaporator plate 17. The dislodged ice cubes will fall into the bin area 12 and are directed away from the trough portion 51 of the sump 50 by the fins 24. Not all water cascading over the surface of the evaporator plate will freeze. The excess water is collected in the trough 51 and returned to the well 52 where it is recirculated to the distributor 26 by the pump 54. After each freezing cycle, a charge of fresh water is delivered to the sump by the water fill valve 59 to dilute the water with impurities and flush through the overflow pipe 55.

Figure 10:
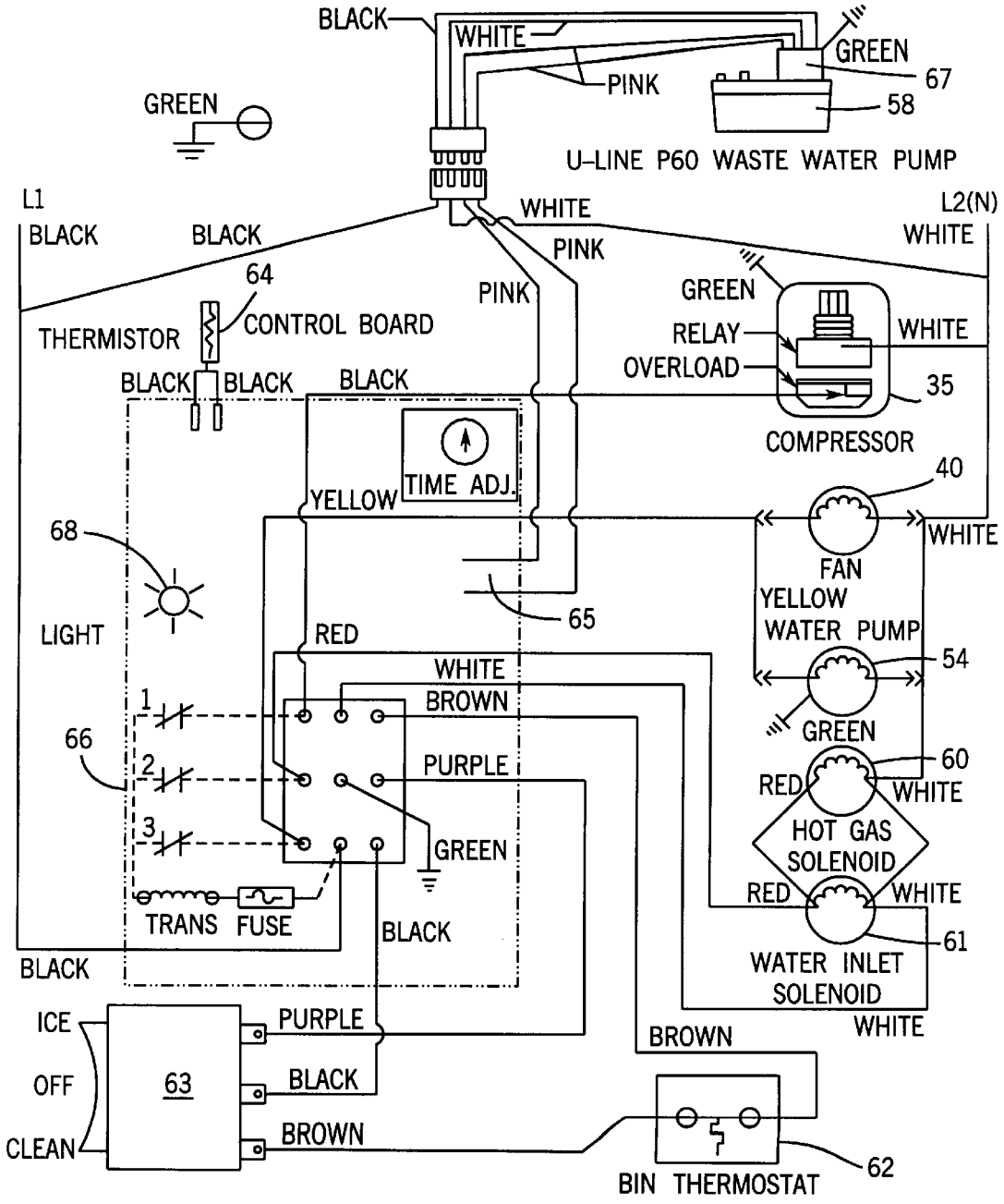
FIG. 10 is a schematic diagram of the electrical system for the ice maker.

FIG. 10 is a schematic diagram of the electrical system for controlling the operation of the compressor motor 35, a solenoid 60 for the hot gas bypass valve 42, the condenser fan 40, the water pump 54, and a solenoid 61 that controls the fresh water inlet valve 59. The operation of the motors and solenoids are controlled by a microprocessor based control 66 that responds to a bin thermostat 62 disposed in the bin 12 in the cabinet 10, a toggle switch 63, a thermistor 64 disposed in the outlet line from the condenser 36, and an optional overflow circuit 65.

The toggle switch 63 is a three-position switch. In one position, the machine will be in the "ice" mode. In a center position, the machine will be in the "off" mode in which all outputs from the control 66 are de-energized. In the third position of the toggle switch 63, the machine will be in a "clean" mode. On initial start-up or restarting with the bin thermostat 62 closed, the toggle switch 63 is placed into the "ice" mode position. This will have the effect of energizing the hot gas bypass solenoid 60 and the water inlet valve solenoid 61 for a period of time. This will fill the sump 50 with fresh water to the level of the overflow pipe 55. Thereafter, the compressor 33, the condenser fan 40, and the water circulation pump 54 are energized. After a short period of time, such as ten seconds, the water fill valve solenoid 61 and the hot gas valve solenoid 60 are de-energized. The machine is now in a freeze cycle.

After a certain predetermined period of time into the freeze cycle, such as four minutes, a reading of the liquid refrigerant temperature sensed by the thermistor 64 is taken. The temperature will be reflective of the temperature of the surrounding environment. This temperature reading will determine the remaining length of time for the freeze cycle. The length of the freeze cycle is adjusted directly based upon the sensed temperature. That is, the higher the temperature of the liquid refrigerant, the longer the freeze cycle. For example, if the liquid refrigerant temperature is 80° F., the total freeze time will be 10.5 minutes. If the sensed temperature is 100° F., the total freeze time will be 17 minutes. At a temperature of 120° F., the freeze time will be 26 minutes. The machine will cease operation if the temperature reaches 175° F. An adjustable potentiometer 70 is located on the control board 66 to add or subtract up to five minutes from the overall freeze time.

When the freeze cycle is completed, the water pump 54 and fan 40 are de-energized and the hot gas solenoid 60 and water inlet solenoid 61 are energized. The compressor remains energized. The hot refrigerant gas flowing through the evaporator 17 will loosen the ice formed in the pockets so that the ice is harvested. One minute prior to the completion of the freeze cycle, a second temperature reading from the thermistor 64 is taken to determine the length of the harvest cycle, which can also vary depending upon the operating environment. The length of the harvest cycle is adjusted inversely based upon the second sensed temperature. For example, if the second sensed temperature is 80° F., a harvest cycle of 2 minutes will be used. If the temperature is 100° F. or above, the harvest cycle will be reduced in time to 1.5 minutes.

Figure 11:
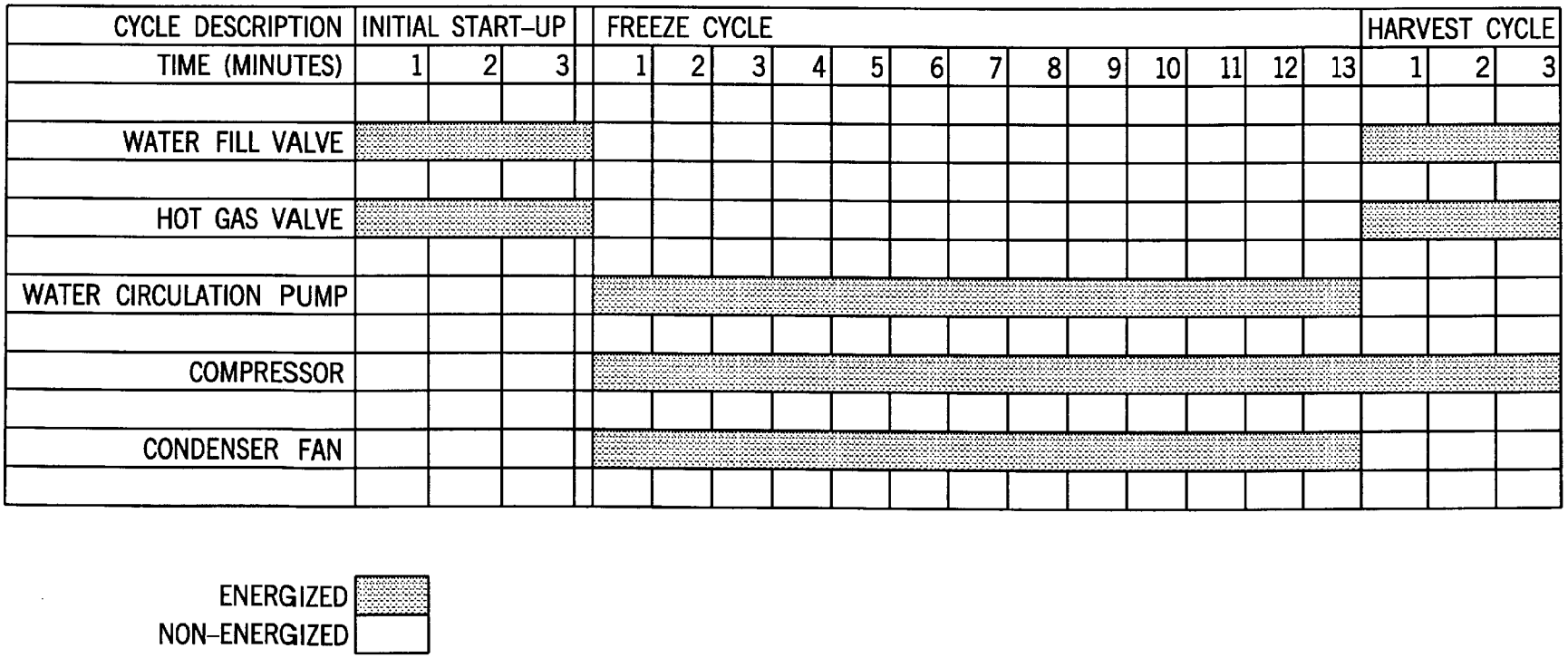
FIG. 11 is a chart illustrating the timing of the actuation of various elements during the production and harvesting of ice.

At the conclusion of the harvest cycle, the control returns to a new freeze cycle with the compressor, water pump, and condenser fan motors all energized and with the hot gas and water inlet solenoids de-energized. The initial start-up, freeze, and harvest cycles are illustrated graphically on FIG. 11.

The machine will continue to cycle through freeze and harvest cycles until the bin thermostat 62 opens, which will remove power to the control. When the bin thermostat 62 recloses, the machine will restart in the cycle shown in FIG. 11. The bin thermostat 62 is located at an upper portion of the bin 12. The bin thermostat 62 responds to the level of ice cubes in the bin 12.

When the toggle switch is in the "clean" position, the control cycles through programmed wash, fill, and rinse cycles. The manner of accomplishing this is disclosed in the aforementioned U.S. Pat. No. 5,586,439.

The optional overflow collector 58 includes a pump 67 that is actuated by a float controlled switch to periodically empty the collector 58. A second overflow switch 65 is located in the collector 58 at a higher level. The overflow switch 65 is closed when the water in the collector 58 rises to a level that indicates that the pump is not working. When the overflow switch 65 closes, the machine will stop operating.

An LED light 68 is mounted on the control board 66 and is connected to the circuit for the thermistor 64. When the circuit for the thermistor 64 is closed, the light 68 will be continuously lit. When the circuit for the thermistor 64 is open, the light 68 will flash at a slow rate. When the thermistor 64 senses an abnormally high fluid refrigerant temperature, such as 175° F., the light 68 will flash at a rapid rate. If the light 68 is off, it indicates that power to the control board 66 has been turned off by the toggle switch 63 or that the overflow switch 65 has interrupted the power to the machine. In this manner, the light 68 functions as a diagnostic aide for servicing the machine.

We claim:

1. A method of controlling the freezing and harvesting of ice cubes in a clear ice maker having a refrigeration system including an evaporator mounted to a metal evaporator plate, a compressor receiving the return refrigerant from the evaporator and connected to a condenser whose outlet communicates with an inlet to the evaporator through a restriction, a fan for cooling the condenser, and a controllable hot gas bypass between the compressor and the evaporator inlet, said ice maker also including a water circulating pump for circulating water over the evaporator plate, the method comprising:

initiating a freeze cycle by closing the bypass and energizing the circulating pump, the compressor, and the condenser fan to circulate water over the plate and form ice thereon;

sensing the temperature of the liquid refrigerant leaving the condenser after the passage of a first fixed time period;

extending the time of the freeze cycle to an amount that is directly related to the sensed temperature;

sensing the temperature of the liquid refrigerant leaving the condenser at a second fixed time before the end of the freeze cycle; and initiating a harvest cycle by de-energizing the circulating pump and the condenser fan and opening the bypass for a period of time that is inversely proportional to the second sensed temperature.

2. A method according to claim 1, wherein the circulating pump circulates water from a sump that is fed from an external source of water through a water fill valve, and the water fill valve is opened during the harvest cycle.

3. A method according to claim 1, wherein an accumulator is interposed between the evaporator and the compressor.

* * * * *